US011292557B2

(12) United States Patent
Dal Pont

(10) Patent No.: US 11,292,557 B2
(45) Date of Patent: Apr. 5, 2022

(54) ELECTRIC DRIVING SYSTEM FOR BOATS

(71) Applicant: Giulia Dal Pont, Treviso (IT)

(72) Inventor: Giulia Dal Pont, Treviso (IT)

( * ) Notice: Subject to any disclaimer, the term of this patent is extended or adjusted under 35 U.S.C. 154(b) by 0 days.

(21) Appl. No.: 16/963,861

(22) PCT Filed: Jan. 22, 2019

(86) PCT No.: PCT/IT2019/050012
§ 371 (c)(1),
(2) Date: Jul. 22, 2020

(87) PCT Pub. No.: WO2019/145984
PCT Pub. Date: Aug. 1, 2019

(65) Prior Publication Data

US 2020/0346721 A1 Nov. 5, 2020

(30) Foreign Application Priority Data

Jan. 23, 2018 (IT) ..... 102018000001652

(51) Int. Cl.
*B63B 32/10* (2020.01)
*B63B 79/10* (2020.01)
(Continued)

(52) U.S. Cl.
CPC ..... *B63B 32/10* (2020.02); *B63B 79/10* (2020.01); *B63H 16/04* (2013.01); *B63H 21/17* (2013.01); *B63B 32/40* (2020.02)

(58) Field of Classification Search
CPC ..... B63B 32/10; B63B 32/40; B63B 79/10; B63H 21/17; B63H 16/04
See application file for complete search history.

(56) References Cited

U.S. PATENT DOCUMENTS 8,851,947 B2 * 10/2014 Vlock ..... B63H 21/21 441/74
9,440,720 B1 * 9/2016 Sawyer, Jr. ..... B63H 16/08
(Continued)

FOREIGN PATENT DOCUMENTS

WO WO 2016/099406 6/2016

OTHER PUBLICATIONS

International Search Report and the Written Opinion dated Mar. 4, 2019 From the International Searching Authority Re. Application No. PCT/IT2019/050012. (12 Pages).

*Primary Examiner* — S. Joseph Morano
*Assistant Examiner* — Jovon E Hayes

(57) ABSTRACT

Described is an electronic system for the movement of boats (10) equipped with an electric water-jet engine (11), comprising a first electronic device(30), composed of a first Bluetooth or Wi-Fi circuit (33), a first accelerometer (34) and at least a first sensor (21) designed to measure a thrust force of the user(1) of the boat (10), which is positioned on the paddle, oar, fin or other palm-like extension (20) of the boat (10) and which communicates the information relative to the thrust force to a second electronic device (40) positioned on the boat (10), which is composed of a second Bluetooth or Wi-Fi circuit (43), a second accelerometer (44), and at least a second sensor (47) designed to measure a thrust force of the electric water-jet engine (11) of the boat (10); the second electronic device (30) is designed to receive and process the information sent from the first electronic device (30) and to control, on the basis of the above-mentioned information, the power of the electric water-jet engine (11) of the boat (10).

5 Claims, 1 Drawing Sheet

(51) Int. Cl.

| | |
|---|---|
| ***B63H 16/04*** | (2006.01) |
| ***B63H 21/17*** | (2006.01) |
| *B63B 32/40* | (2020.01) |

(56) References Cited

U.S. PATENT DOCUMENTS

| | | | | |
|---|---|---|---|---|
| 10,017,233 | B2 * | 7/2018 | Ajello | B63B 32/10 |
| 2011/0212691 | A1 * | 9/2011 | Rott | H04B 1/3827 455/41.3 |
| 2011/0223816 | A1 * | 9/2011 | Boukas | B63H 21/17 440/6 |
| 2020/0109954 | A1 * | 4/2020 | Li | G05D 1/0274 |
| 2020/0346721 | A1 * | 11/2020 | Dal Pont | B63H 21/17 |

* cited by examiner

ELECTRIC DRIVING SYSTEM FOR BOATS

RELATED APPLICATIONS

This application is a National Phase of PCT Patent Application No. PCT/IT2019/050012 having International filing date of Jan. 22, 2019, which claims the benefit of priority of Italian Patent Application No. 102018000001652 filed on Jan. 23, 2018. The contents of the above applications are all incorporated by reference as if fully set forth herein in their entirety.

FIELD AND BACKGROUND OF THE INVENTION

This invention relates generically to an electronic system used for controlling the movement of boats, by the thrust action of a user combined with the action of an electric water-jet engine.

In more detail, the invention relates to an electronic system which allows the users (generic users, sportspeople and/or users with disabilities) of boats or water sports equipment in general, such as, for example, canoes, kayaks, Stand Up Paddles (SUP) or the like, which require the use of paddles and/or oars, as well as fins or palm-like extensions for their movement, to increase the propulsion offered by the muscles of the human body, in a synchronous and proportional manner, by means of the force exerted by means of an electric water-jet engine mounted on the boat (canoe, kayak, Stand Up Paddle (SUP), etc.).

The current electrical propulsion systems with water-jet engines for water sports do not provide for any functional connection with the force exerted by the user and the speed of forward movement is regulated by acting manually on a regulating device for increasing or decreasing the speed.

SUMMARY OF THE INVENTION

The electronic system relative to this invention allows, on the other hand, a true and proper assisted paddling to be obtained, by modulating the power of the electric water-jet engine proportionally to the intensity of the muscular effort exerted by the rower. The coordination of the thrust of the engine with the muscular propulsive force exerted by the rower allows, as well as an increase in the speed thanks to the assisted thrust of the engine, a decrease in the muscular effort necessary for forward movement of the boat.

The electronic devices used in the system according to the invention are as follows:

- a first electronic device composed substantially of an electronic circuit with processor, Bluetooth or Wi-Fi circuit, gyroscope, accelerometer and sensors for detecting the pushing force of the user, all powered by one or more batteries rechargeable with a USB cable or induction system controlled by dedicated software and firmware, positioned on the paddle, oar(s), fin(s) or other palm-like extensions(s) of the boat and designed to detect, by means of specific sensors, the force of the muscular thrust exerted by the rower on the paddle, oar, fin or other palm-like extension, and to communicate this information to a second electronic device;
- a second electronic device composed substantially of an electronic circuit with processor, Bluetooth or Wi-Fi circuit, gyroscope, accelerometer, GPS and sensors for detecting the thrust of the electric motor of the boat, all powered by one or more batteries rechargeable with a USB cable or induction system controlled by dedicated software and firmware, positioned on the boat, such as canoe, kayak, Stand Up Paddle (SUP) or the like, which is designed to receive and process the information sent by the first electronic device relative to the force of the muscular thrust exerted by the rower and to control the electric water-jet engine of the boat.

The aim of the invention is therefore to provide an electronic system for the movement of boats, such as canoes, kayaks, Stand Up Paddles (SUP), by means of an electric engine (assisted paddling), by generic users, sportspersons and/or users of the boats with disabilities, which is able to proportionally coordinate the force of the muscular thrust of the rower and the thrust exerted by an electric water-jet engine fitted to the boat in order to obtain the following advantages:

- reducing the quantity of energy necessary for the battery for powering the electric water-jet engine, thanks to the greater efficiency of the propulsive system, integrated with the muscular force of the rower, with respect to the prior art;
- increasing the level of satisfaction for the user due to the dynamic interactivity between muscular propulsive force exerted by the rower and the mechanical thrust of the electric engine;
- increasing efficiency of the muscular effort for users with disabilities or poor muscle tone.

Moreover, thanks to the assisted paddling achieved according to the invention, the user may travel more easily against the wind and against the current and reach the shore in difficult conditions, and also, thanks to the reduced electricity consumption associated with the increase in speed, the user will be able to undertake longer trips with greater satisfaction and less fatigue.

There are no electronic systems similar to that of this invention currently on the market.

BRIEF DESCRIPTION OF THE SEVERAL VIEWS OF THE DRAWINGS

Further characteristics and advantages of the electronic system for the movement of boats, such as canoes, kayaks, Stand Up Paddles (SUP) and the like, by means of an electric engine (assisted paddling), by generic users, sportspersons or people with disabilities, designed to proportionally coordinate the force of the muscular thrust of the rower and the thrust exerted by an electric water-jet engine fitted to the boat, according to the invention, will more fully emerge from the description that follows, relative to a preferred embodiment thereof given by way of non-limiting example, and from the appended drawings, in which.

DESCRIPTION OF SPECIFIC EMBODIMENTS OF THE INVENTION

Figure 1:
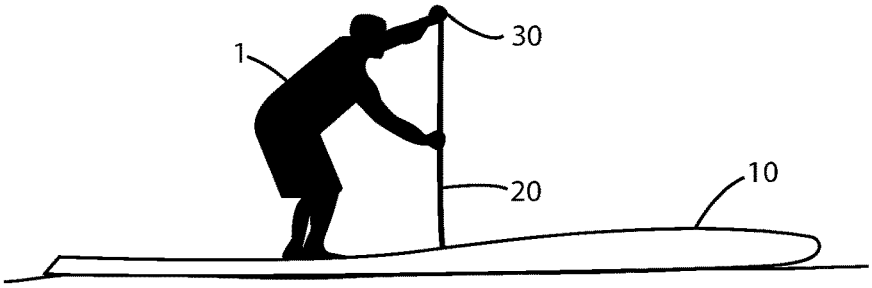
FIG. 1 is a schematic side view of a boat or water sports equipment (in this case, a canoe) operated by a rower.
Figure 2:
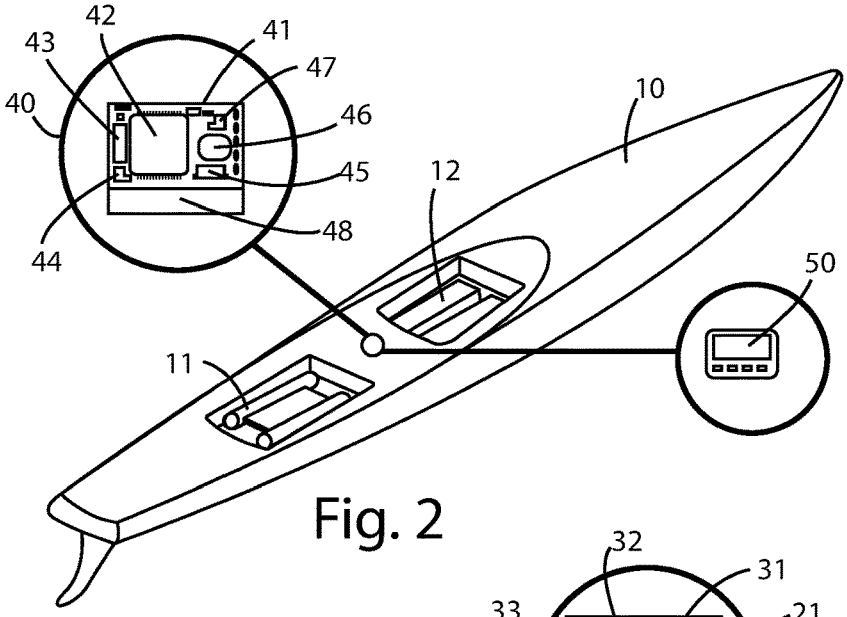
FIG. 2 is a detailed perspective view of the boat equipped with the electronic movement system in accordance with the invention.
Figure 3:
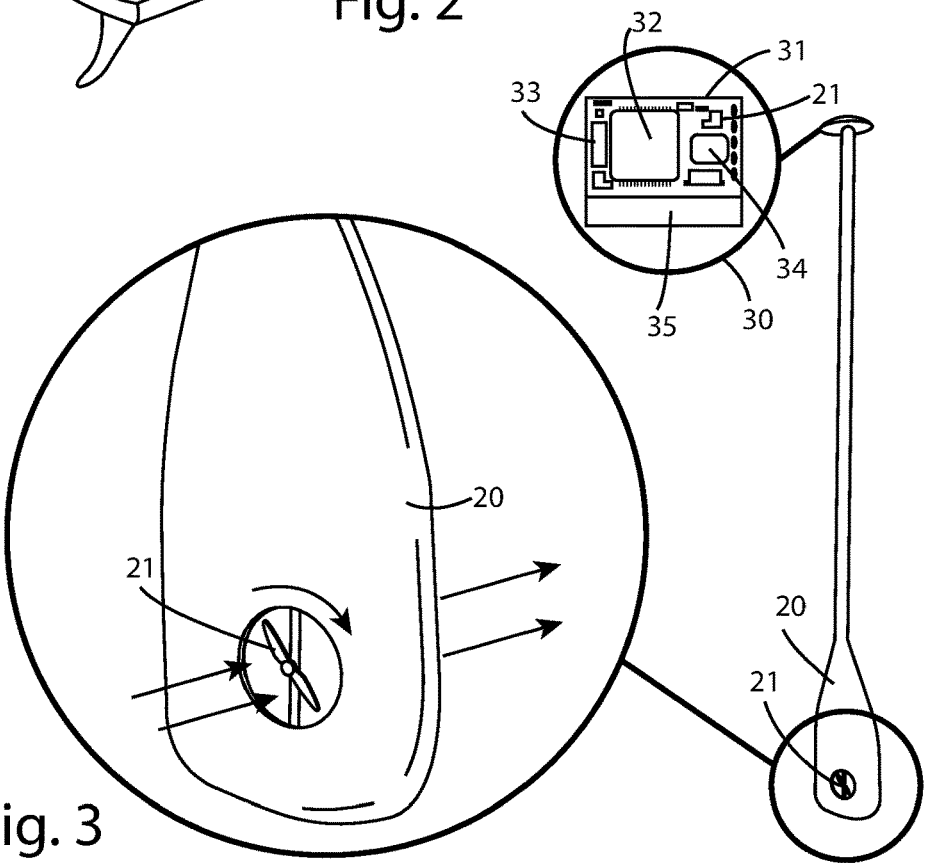
FIG. 3 shows an oar or paddle of the boat of FIGS. 1 and 2 equipped with the electronic movement system in accordance with the invention.

It should be firstly noted that, even though explicit reference is made below to specific boats, such as canoes, kayaks and Stand Up Paddles (SUP), as well as to paddles or oars, the invention can be advantageously applied to any type of boat or water sports equipment, for any means of manual thrust (such as fins and palm-like extensions in general) of the boat, as well as by any type of user, such as rowers, sportspersons, generic users and/or persons with disabilities.

More specifically, the canoe illustrated in the appended drawings has a propulsion unit or electric water-jet engine, a series di batteries powering the engine and an electronic movement device equipped with a relative display, whilst the paddle is equipped with a relative electronic device, which incorporates a sensor of the intensity of the muscular force exerted by the rower, inserted in the surface of the paddle (the above-mentioned sensor may be a helix-like sensor arranged in the direction of forward movement of the boat).

The electronic device present on the paddle is also equipped with a pressure sensor (positioned on the rear surface of the paddle), which is able to detect the weight force due to the compression of the water on the surface of the paddle (this weight force, expressed in g/cm$^2$, corresponds to the intensity of the force exerted by the muscles of the rower to push the water backwards and promote the forward movement of the boat), and an extensometer sensor, usually located on the shaft of the paddle, which is able to detect the bending of the shaft and the consequent thrust of the paddle against the water (it should be noted that the type and place of application of the above-mentioned sensor are indifferent providing they detect the muscular force exerted by the rower for the thrust on the water).

With particular reference to the drawings, the user or rower (1), who uses a boat or water sports equipment (10) on which there is an electric water-jet engine (11) powered by batteries (12) and who uses a paddle or oar (20) to determine movements of the boat (10), may use, according to the invention, an electronic system for coordinating in a synchronised and proportional manner the relative thrust or muscular force and the propulsive force of the electric water-jet engine; the electronic system is composed of two electronic devices (30, 40) positioned, respectively, inside the paddle or oar (20) and in the boat (10).

The paddle or oar (20) has, preferably on the relative lower surface, a helix-like sensor (21) arranged in the direction of forward movement of the intensity of the muscular force exerted by the rower for moving the water and producing the forward movement of the boat (10), in such a way that an increase in the muscular thrust on the paddle (20) corresponds to an increase in the revolutions of the helix as a result of the flow of water moved; the helix-like sensor (21) is controlled by the electronic device (30), positioned in the upper part of the shaft of the paddle (20) and consisting of an electronic circuit (31), a microprocessor (32), a wireless circuit for the transmission of signals (33), such as a Bluetooth chip or Wi-Fi, and an accelerometer (34), all powered by a button and/or rechargeable battery (35).

When the user/rower (1) uses the above-mentioned paddle (20), the electronic device (30) collects the data of the helix-like sensor (21) and of the accelerometer (34) and processes and sends it in real time, using the wireless circuit (33), to the electronic device (40) present on the boat (10) and connected to the electric water-jet engine (11).

The data received from a respective wireless circuit for the transmission of signals (43), such as a Bluetooth chip or Wi-Fi, of the electronic device (40) is controlled by the microprocessor (42), installed on the electronic circuit (41), where there are also an accelerometer (44), a gyroscope (45), a GPS chip (46) and a sensor (47) of the speed of rotation of the helix of the electric water-jet engine (11), which are powered by a button and/or rechargeable battery (48) and which allow modulation of the activation and the power of the electric water-jet engine (11) in a synchronous and proportional manner with the activity detected by the helix-like sensor (21) inserted in the paddle (20).

The coordination of the thrust of the electric water-jet engine (11) with the muscular propulsive force exerted by the rower (1), measured by the helix-like sensor (21) inserted in the paddle (20), allows an increase or decrease in the speed of the boat (10) thanks to the assisted thrust of the electric water-jet engine (11) and, consequently, allows an increase or decrease in the muscular effort necessary by the rower (1) for forward movement of the boat.

Moreover, the synchronisation and the modulation of power of the electric water-jet engine (11) with the speed and with the force of the muscular thrust measured by the helix-like sensor (21) inserted in the paddle (20) annul inadequate and destabilising propulsive thrusts by the electric water-jet engine (11); the user/rower (1) may also manually select, by means of a display (50) of the boat (10), the ratio between the number of rotations of the helix-like sensor (21) installed on the paddle (20) and the number of revolutions of the electric water-jet engine (11), in order to establish the extent of the assistance provided by the electric water-jet engine (11).

The invention described can be modified and adapted in several ways without thereby departing from the scope of the inventive concept.

Further, all the details can be replaced by other technically-equivalent elements. Lastly, the components used, providing they are compatible with the specific use, as well as the dimensions, may vary according to requirements and the state of the art.

Where the characteristics and the techniques mentioned in the following claims are followed by reference signs, the reference signs have been used only with the aim of increasing the intelligibility of the claims themselves and, consequently, the reference signs do not constitute in any way a limitation to the interpretation of each element identified, purely by way of example, by the signs numbers.

What is claimed is:

1. An electronic driving system for boats (10), said boats (10) being equipped with an electric water-jet engine (11) connected to a series of supply batteries (12) and being moved by a user (1) through at least a paddle, oar, fin or extension (20), wherein said driving system comprises:

a first electronic device (30) composed of an electronic circuit (31), a first processor (32), a first Bluetooth or Wi-Fi circuit (33), a first accelerometer (34) and at least one first sensor (21) for detecting a pushing force of the user (1), said first electronic device (10) being positioned on said paddle, oar, fin or extension (20) of the boat (10) and said first Bluetooth or Wi-Fi circuit (33) being able to communicate the information relating to said pushing force to a second electronic device (40) placed on the boat (10);

wherein the second electronic device (40) placed on the boat (10) and composed of a second electronic circuit (41), a second processor (42), a second Bluetooth or Wi-Fi circuit (43), a second accelerometer (44), a gyroscope (45), a GPS chip (46) and at least a second sensor (47) for detecting a thrusting force of said electric water-jet engine (11) of the boat (10), said second processor (42) and said second Bluetooth or Wi-Fi circuit (43) being able to receive and process the information sent by said at least one first sensor (21) and said first accelerometer (34) of said first electronic device (30) and to manage, based on said information, power of said electric water-jet engine (11) of the boat (10).

2. The electronic driving system according to claim 1, wherein said at least one first sensor (21) is arranged on a surface of said paddle, oar, fin or extension (20), which is placed transversally with respect to the advancement direction of said boat (10).

3. The electronic driving system according to claim 1, wherein said first electronic device (30) is provided with at least one second strain-gauge sensor, placed on said paddle, oar, fin or extension (20), which is configured to detect a bending force of said paddle, oar, fin or extension (20).

4. The electronic driving system according to claim 2, wherein said first sensor detects a number of revolutions of a helix which are proportional to the flow of water moved by said boat (10).

5. The electronic driving system as claimed in claim 1, wherein said boat (10) has a display (50), on which said user (1) can select the ratio between the number of rotations of said first sensor and the number of revolutions of the electric water-jet engine (11).

* * * * *